US006131664A

United States Patent [19]

Sonnier

[11] Patent Number: 6,131,664

[45] Date of Patent: Oct. 17, 2000

[54] SYSTEM, APPARATUS, AND METHOD FOR INSTALLING CONTROL LINES IN A WELL

[76] Inventor: Errol A. Sonnier, 202 Oakmont Cir., Lafayette, La. 70518

[21] Appl. No.: 09/404,948

[22] Filed: Sep. 24, 1999

Related U.S. Application Data

[60] Provisional application No. 60/101,882, Sep. 25, 1998.

[51] Int. Cl.[7] ..... E21B 19/02

[52] U.S. Cl. ..... 166/381; 166/341

[58] Field of Search ..... 166/381, 339, 166/341, 343; 175/85, 203, 202

[56] References Cited

U.S. PATENT DOCUMENTS

| | | | |
|---|---|---|---|
| 3,722,584 | 3/1973 | Nelson | 175/85 X |
| 4,106,575 | 8/1978 | Bunnelle | 175/170 |
| 4,274,778 | 6/1981 | Putnam et al. | 175/85 X |
| 4,281,716 | 8/1981 | Hall | 166/339 |
| 5,503,234 | 4/1996 | Clanton | 175/52 |

*Primary Examiner*—Frank S. Tsay
*Attorney, Agent, or Firm*—Browning Bushman

[57] ABSTRACT

A method and apparatus for installing control lines and pipe into a well. The work surface for equipment and personnel employed in assembling the pipe is elevated above the rig floor. Personnel operating below the work surface use clamps to attach control lines to the pipe being installed in the well. The pipe-holding spiders that arc normally mounted on the rig floor are mounted on the elevated work surface. Assembling the control lines to the pipe below the work surface permits the control lines to be attached to the pipe without first traveling through the spider.

18 Claims, 2 Drawing Sheets

SYSTEM, APPARATUS, AND METHOD FOR INSTALLING CONTROL LINES IN A WELL

RELATED APPLICATIONS

This application claims the benefit of U.S. Provisional Application Ser. No. 60/101,882, filed Sep. 25, 1998.

BACKGROUND OF THE INVENTION

1. Field of the Invention

The present invention relates to methods and means for inserting pipe into a well. More specifically, the present invention relates to systems, methods, and apparatus for attaching conduit used as control lines and injection lines to a string of pipe being inserted into a well.

2. Description of the Prior Art

Oil and gas wells are sometimes equipped with tubing lines or small diameter conduits that regulate the opening and closing of valves contained within the pipe string or that inject fluids into the well. The lines typically are secured to the outside of the pipe string. The lines used for control can regulate the opening and closing of subsurface valves employed in the production pipe strings in offshore wells to permit the wells to be closed in below the sea bottom. The lines used for injection are frequently employed to add corrosion control or other treating fluids to the fluid being produced from the well. The lines, or conduits, referred to herein generically as "control lines," are relatively small diameter, continuous, thin-walled tubes that can easily be damaged during their installation into the well.

The conventional technique for installing control lines with the pipe string requires that the control lines extend alongside the pipe through the pipe clamp, "slips," or "spider" used to support the pipe string from the rig floor. The control line is clamped to the pipe, and the clamp, control line, and pipe are lowered through the open spider into the well. Special provision must be made in the spider so that the control line may safely extend past the pipe-gripping slips contained within the spider. If the control line becomes trapped radially between the slips and the pipe, or circumferentially between the slip segments, the control line will be crushed or ruptured. To avoid this, the control line is typically positioned in a gap between adjacent segments of the slips or is passed through a special recessed area formed through or alongside the central opening of the spider body.

In some offshore installations, it is necessary to employ several control lines with each string of production tubing. Deep, offshore well completions may require as many as four or more separate control lines, or packets of control lines, with each string of production pipe that is run into the well. The presence of multiple control lines requires that the lines be attached to the pipe in a circumferential arrangement that will permit them to clear the slip segments in the spider. Such an arrangement may not necessarily be the best arrangement for the well design. The clamping mechanisms required to secure multiple control lines to the pipe may also interfere with the operation of the spider slips. The requirement for multiple control lines to extend through the spider also increases the danger of damage to the lines and renders the process more time-consuming and difficult.

SUMMARY OF THE INVENTION

The method and apparatus of the present invention allows multiple control lines to be attached to a string of well pipe without requiring that the lines extend through the spider used to support the string. The spider is elevated above the rig floor on a work surface that permits access to the string below the spider. The control lines are secured to the pipe in the interval below the spider and above the rig floor in a work area removed from that of the personnel operating the pipe joining equipment. Multiple lines may be secured to the pipe string at any desired circumferential locations about the pipe without regard to the design or location of the spider slips. The size and design of the clamp used to secure the lines to the pipe are also independent of the restrictions imposed by the slips and the internal dimensions of the spider. The connection of the lines to the pipe and the lowering of the assembly into the well are performed more easily and rapidly without the dangers associated with running the lines through the spider.

Conventional systems for running the control lines include sheaves mounted in the tops of the derrick and other arrangements that assist in aligning the control lines with the side of the pipe to facilitate connection of the lines to the pipe. The method of the present invention supplies the control lines laterally relative to the axis of the well pipe, through the access area, without need for aligning the control lines with the pipe side above the pipe slips since the controls lines are not required to extend through the pipe slips. Thus, it will be appreciated that an important distinction between the method of the present invention and that commonly employed in the prior art is that the control lines are supplied directly to the access area in which they are to be secured to the pipe from a lateral direction, without need for extending parallel to the pipe axis from a position above the access area.

From the foregoing, it will be appreciated that a primary object of the present invention is to provide a method and apparatus for connecting one or more control lines to a string of well pipe being run into a well without extending such control lines through the spider used to support the pipe string.

Another object of the present invention is to provide an apparatus and method for running multiple control lines with an associated pipe string wherein the control lines may be attached to the pipe at any desired location about the circumference of the pipe.

It is also an important object of the present invention to provide an apparatus and method where multiple control lines may be secured to a well string using a clamp that is not restricted in design or dimensions by the operation or dimensions of the spider used to support the pipe.

Yet another object of thc present invention is to provide a method and apparatus for reducing the time and effort required to secure control lines to a string of well pipe being run into a well.

It is also an object of the present invention to provide an apparatus and method in which multiple control lines may be simultaneously spooled from separate reels and secured to the pipe string at circumferentially spaced locations about the pipe.

An important object of the present invention is to provide a method, system, and apparatus for allowing one or more control lines to be secured to a pipe string by a clamp that is attached to the pipe below the device supporting the well string from the drilling ring floor.

A related object of the present invention is to provide a work area for personnel to secure control lines to a well pipe at a location that is removed from the work area of the equipment used to make up the pipe.

Another object of the invention is to connect control lines to a string of pipe without first running the control lines over a sheave suspended from the derrick of the drilling or completion rig.

The foregoing, as well as other, objects, features, and advantages of the present invention will be more fully appreciated and understood by reference to the following drawings, specification, and claims.

DESCRIPTION OF THE ILLUSTRATED EMBODIMENTS

Figure 1:
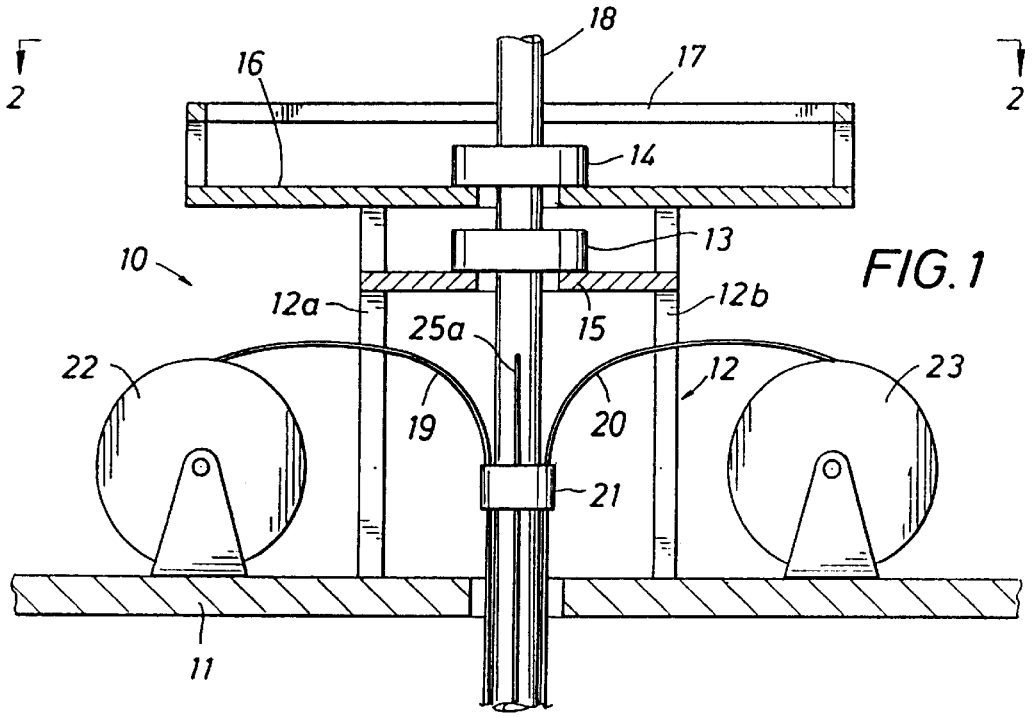
FIG. 1 is a vertical elevation, partially in section, illustrating the apparatus of the present invention mounted on a rig floor assembling control lines to a string of well pipe being run into a well.

The apparatus of the present invention is indicated generally at 10 in FIG. 1. A rig floor 11 supports a window platform 12 that in turn supports the spiders 13 and 14. The spider 13 is supported on a subfloor 15, and the spider 14 is supported on a work floor 16. Both spiders may be supported on the subfloor 15, or only a single spider may be employed to run the pipe string. A workman's guardrail 17 extends around the perimeter of the work floor 16.

A well pipe 18 extends through the spiders 14 and 13, through the rig floor 11, and into the well (not illustrated). Control lines 19 and 20 are illustrated attached to the pipe 18 with a clamp 21. The control line 19 extends laterally from a supply reel 22, and the control line 20 extends laterally from a supply reel 23.

Figure 2:
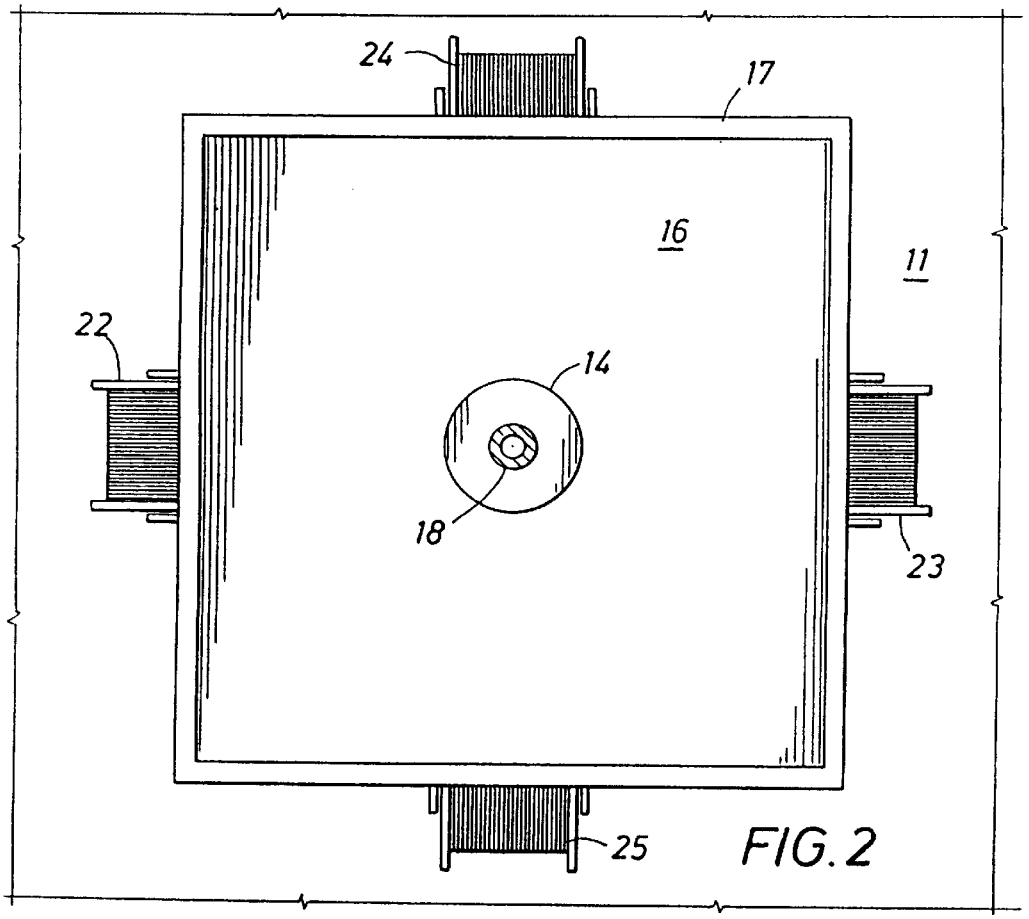
FIG. 2 is an overhead view taken along a line 2—2 of FIG. 1.

FIG. 2 illustrates an overhead view of the apparatus 10. Two additional conduit supply reels 24 and 25 are illustrated in position to provide control lines to the pipe 18 in a manner similar to that of the reels 22 and 23 illustrated in FIG. 1.

As may best be seen by joint reference to FIGS. 1 and 2, the window platform 12 has four legs, each of which is like the legs 12*a* and 12*b*, at each corner of the window. The spacing between the four legs provides four separate openings through which the control lines may be fed from the reels adjacent the openings. A control line 25*a* extending from the reel 25 (not illustrated in FIG. 1) is illustrated secured to the front of the well pipe 18. If desired, two or more reels may supply conduit through a single window. The reels may be set at different locations on the rig.

In a preferred embodiment, the opening between the rig floor 11 and the base of the subfloor 15 is approximately six or seven feet to permit personnel ample room to work below the overhead spiders. Smaller or larger openings may be employed advantageously as required by the space or other limitations on the rig.

The lateral spacing between the legs may be four feet or more as desired to provide sufficient structural support for the spiders and the weight of the supported pipe string while permitting access to the workspace below the spiders.

The lateral dimensions of the work surface 16 may be as large as necessary to provide the work area necessary to accommodate the tongs and personnel required to connect additional pipe segments to the string as it is being run into the well.

In a preferred embodiment, the spiders 13 and 14 comprise a method and system such as described in U.S. Pat. No. 5,732,909, which is incorporated herein, in its entirety, by reference.

The method and apparatus for engaging the pipe 18 by the elevator (not illustrated) are described in U.S. patent application Ser. Nos. 08/670,639, filed Jun. 26, 1996; 60/079,276, filed Mar. 25, 1998; and 09/265,318, filed Mar. 9, 1999, which are also incorporated herein, in their entirety, by reference.

Figure 3:
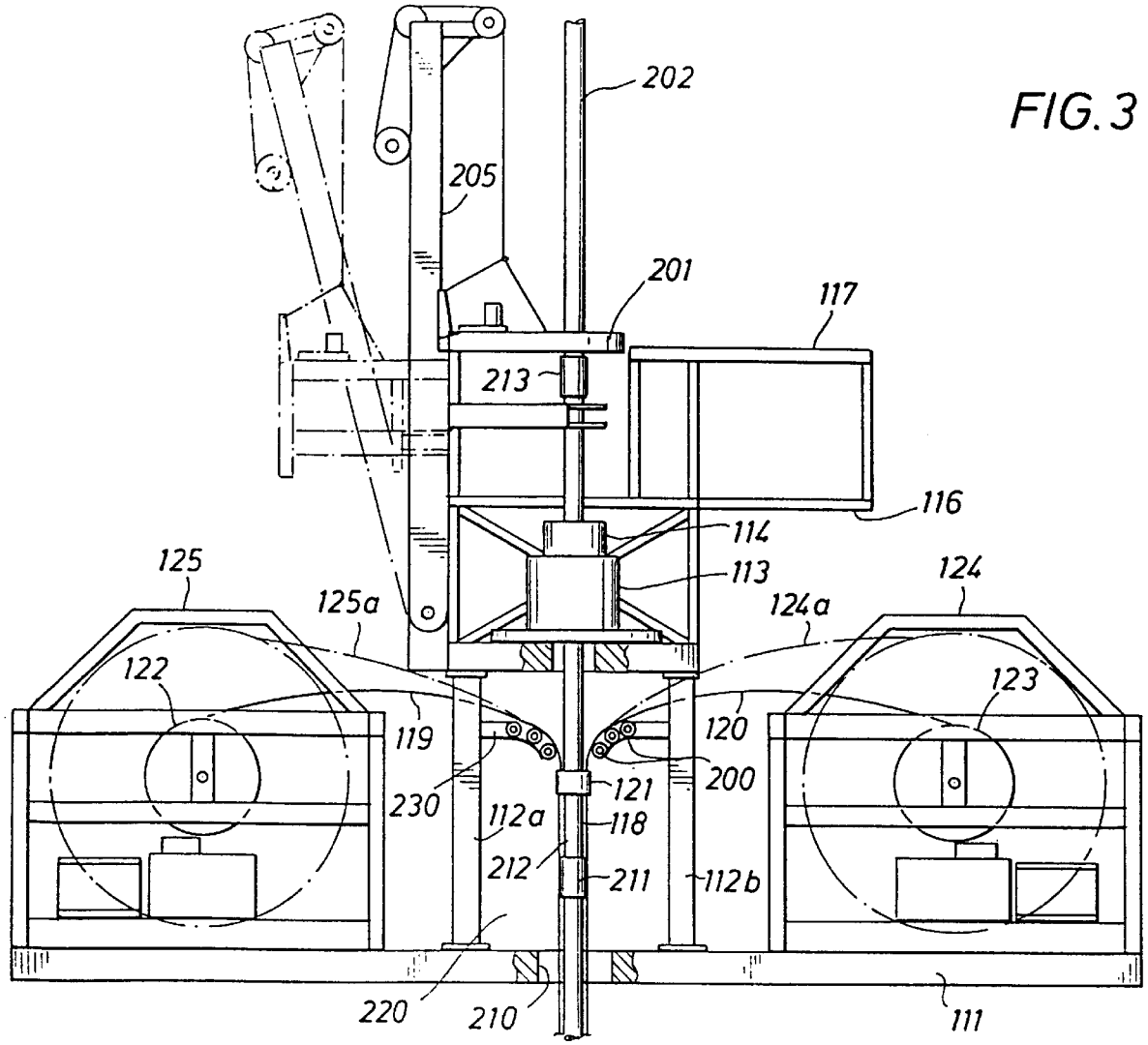
FIG. 3 is a vertical elevation illustrating a system of the invention having integral backup hydraulic tongs suspended over the work area by a movable support mast.

The components of FIG. 3 are identified by reference numbers that are 100 units greater than the reference numbers of corresponding components in the system of FIGS. 1 and 2.

With reference to FIG. 3, the reel 123 supplies a control conduit 120 to a clamp 121 securing the control line to a pipe string 118. The conduit 120 extends over a number of roller guides 200 that assist in conducting the control line 120 to the pipe 118. The roller guides 200 may be powered by hydraulically operated piston-cylinder assemblies 230 as required to assist in directing a stiff control line 120 from its lateral position into an axial position against the pipe string 118. When the control line 120 is comprised of a series or bundle of control lines secured together in a packet, the assembly can be very stiff. The roller guides 200 assist in bending the packets coming laterally off of the reel 123 into an axially parallel position alongside the pipe string 118.

Personnel working on the platform 116 employ a hydraulic tong 201 to connect an additional pipe joint 202 into the top of the string 118. The work floor 116 provides a work area that elevates personnel operating the tongs 201 above the work area where the control lines are being secured to the pipe string. Thus, in addition to allowing the control lines to be connected to the pipe without first passing through the spiders 113 and 114, the present invention allows the personnel to perform the job of adding or removing pipe in a work area that is removed from the work area of the personnel securing the control lines and clamps 121 to the well pipe 118.

The structure supporting the hydraulic tongs includes a hydraulically powered pivoting mast 205 that can be moved into the solid line position illustrated in FIG. 3 to make up or back out pipe sections 202. The mast 205 is removed from the work area when pivoted back, as illustrated in the dotted line position of the mast 205.

In practicing the method of this invention, control lines, such as the lines 119 and 120, 125*a*, and 124*a*, are spooled to the pipe string 118 without first passing through the spiders or slips supporting the pipe string. The control lines extend through an access area formed intermediate the support structure holding the pipe and the rig floor. The length of the access opening is determined by the height of the pillars 112*a* and 112*b*. The slips 113 and/or 114 support the pipe so that it extends through an opening 210 in the floor 111. The pipe 118 is illustrated with a coupling 211 at the base of a pipe section 212 having a second coupling 213 at its upper end. The pipe section 202 is being made up into the coupling 213 to lengthen the string 118.

With the pipe in the position illustrated in FIG. 3, the clamp 121 is applied around the control lines and the pipe section 212 to secure the control lines to the pipe. The clamp 121 may be of any conventional type that is suitable for the purpose of clamping the control lines to the pipe. Typically, the interface between the inside of the clamp and the outside of the pipe to which it clamps is configured to tightly receive the control lines, or control packets, extending from the reels so that the lines or packets are restrained from circumferential and/or axial movement relative to the pipe. A mechanical lock, such as a bolt and nut arrangement (not illustrated) may be employed to secure the clamp in place. Once clamped, the pipe and control line assembly is lowered through the opening 210 into the well until the top (not illustrated) of the joint 202 is in the position of the coupling 213. The slips 113 and 114 are set, and an additional joint of pipe is then added to the string with the use of the power tongs 201. Additional clamps 121 may be added to hold the control lines to the pipe as required. The clamps may be added with each new joint of pipe that is added or several joints of pipe may be run before an additional clamp is employed.

An access area 220 is formed below the support structure holding the slips 113 and the rig floor 111. The access area 220 allows personnel to secure the clamp 121 to the pipe 118 without having to work in the same work area as that required by the operators of the tongs 201. Since the control lines do not extend through the slips 113 or 114 or through the work area of the personnel operating the tongs, the string and attached control lines may be assembled and lowered into the well much more rapidly and without danger of damage to the control lines.

The roller guides 200 can be moved by the hydraulically powered piston-cylinder assemblies 230 to change the position of the control lines relative to the pipe. The assemblies 230 may be powered by the same hydraulic system used for powering the hydraulic tongs and for pivoting the mast support 205. It may be appreciated that pneumatic or electrical assemblies may be employed for powering or moving the various components of the invention. The roller guides 200 also apply a tensioning force to the control lines to prevent over-reeling from the supply reels and to maintain tension in the control lines already connected to the pipe.

It may also be appreciated that the system, method, and apparatus of the present invention may be modified whereby the control line feeds through an opening in the support structure holding the spider before entering the clamp application area. While such a modified form of the invention is less desirable than the preferred form of the invention because the control line and the tong crew occupy the same work area, the modification nevertheless is advantageous in that it provides a separate work area below the slip support structure for clamping the control line in the pipe.

While a preferred form of the present invention has been described herein, various modifications of the apparatus and method of the invention may be made without departing from the spirit and scope of the invention, which is more fully defined in the following claims.

What is claimed is:

1. A method for running a well pipe into a well with control lines attached to the pipe, comprising:

securing a spider above a rig floor;

supplying the control line to the pipe at a location below the spider and above the rig floor;

securing the control line to the well pipe below the spider; and lowering the pipe and secured control line into the well.

2. An apparatus for running well pipe into a well with control lines attached to the pipe, comprising:

a support structure for supporting a spider at a distance above a rig floor sufficient to provide an accessible work space between the support structure and the floor;

a spider supported by said support structure for holding a pipe string extending through said support structure and into said well;

a clamp between said rig floor and said spider for securing a control line to said well pipe; and one or more control lines extending from a supply source to said clamp and along said pipe without extending through said spider.

3. A method of inserting an axially extending pipe string and one or more control lines into a well, comprising the steps of:

providing an elevated support structure over a floor opening on a rig floor whereby an access area is formed between the support structure and the rig floor;

supporting the pipe from the elevated support structure whereby the pipe extends axially through the access area and through the floor opening;

feeding, from a supply source, one or more control lines through the access area to the pipe; and lowering the pipe and the control lines through the floor opening while feeding control lines from said supply source through said access area.

4. A method as defined in claim 3, comprising the further step of adding pipe to the pipe string above the support structure.

5. A method as defined in claim 3, comprising the further step of elevating a work area of the personnel adding pipe to the string above that of a work area of the personnel securing the control lines to the pipe.

6. A method as defined in claim 3, further comprising the step of moving a power tong away from the pipe string when the power tong is not in a working position.

7. A method as defined in claim 3 wherein said control lines arc fed laterally through said access area.

8. A method as defined in claim 3 wherein said control lines are fed through said access area without passing through said support structure.

9. A method as defined in claim 3 wherein said one or more control lines feed through said access are intermediate the rig floor and the location where said pipe is supported from said structure.

10. A method as defined in claim 3 wherein said control lines are fed through said access area by guides to orient the control lines with said pipe.

11. A method as defined in claim 10 wherein said guides are movable relative to said support structure to change the position of said control lines relative to said pipe.

12. A method as defined in claim 10 wherein said guides are movable by hydraulically powered piston-cylinder assemblies.

13. A system for inserting a pipe string and one or more control lines into a well, comprising:

an elevated support floor spaced above a rig floor having a rig floor opening;

an access opening defined between said elevated support floor and said rig floor;

a pipe-holding mechanism carried by said support floor for holding a pipe string extending through said rig floor opening;

a pipe makeup area carried by said support floor for adding pipe to or removing pipe from said pipe string;

a control line supply source for supplying control line to said well;

a control line extending from said supply source to said pipe string through said access opening; and a clamp securing said control line to said well pipe.

14. A system as defined in claim 13 wherein said pipe makeup area includes a power tong.

15. A system as defined in claim 13 wherein said pipe-holding mechanism comprises a slip bowl and slips.

16. A system as defined in claim 13 wherein said pipe makeup area comprises a personnel work area having tools for making up and breaking out pipe connections in said pipe string.

17. A system as defined in claim 13 wherein said access opening provides an area sufficiently large to permit personnel entry for manual application of a clamp and control line to said pipe string below said support floor.

18. A system as defined in claim 13 wherein said control line supply source comprises a reel of control line feeding said control line directly through said access opening without extending through said elevated support floor.

* * * * *